US006428164B1

(12) United States Patent
Missell et al.

(10) Patent No.: US 6,428,164 B1
(45) **Date of Patent: *Aug. 6, 2002**

(54) INK JET PRINTING PROCESS

(75) Inventors: Gregory E. Missell, Penfield; Christine Suminski, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/579,592

(22) Filed: May 26, 2000

(51) Int. Cl.[7] ..... B41J 2/01
(52) U.S. Cl. ..... 347/105; 428/195; 428/323
(58) Field of Search ..... 428/195, 306, 428/391, 364, 532; 347/105, 106

(56) References Cited

U.S. PATENT DOCUMENTS 5,522,968 A 6/1996 Kuroyama et al.
5,605,750 A * 2/1997 Romano et al. ..... 428/304.4
5,635,297 A 6/1997 Ogawa et al.

* cited by examiner

*Primary Examiner*—Bruce H. Hess
*Assistant Examiner*—Michael Grendzynski
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with an ink jet recording element comprising a resin-coated paper support having thereon an ink-retaining layer comprising voided cellulosic fibers and organic or inorganic particles in a polymeric binder, the length of the voided cellulosic fibers being from about 10 $\mu$m to about 50 $\mu$m, the ratio of the voided cellulosic fibers to the organic or inorganic particles being from about 90:10 to about 60:40 and the ratio of the combination of voided cellulosic fibers and the organic or inorganic particles to the polymeric binder being from about 90:10 to about 50:50;

C) loading the printer with an ink jet ink composition; and

D) printing on the ink jet recording element using the ink jet ink in response to the digital data signals.

4 Claims, No Drawings

INK JET PRINTING PROCESS

Reference is made to commonly-assigned, copending U.S. Patent Applications:

Ser. No. 09/579,591, filed of even date herewith, of Missell et al., entitled "Ink Jet Printing Process";

Ser. No. 09/579,635, filed of even date herewith, of Missell et al., entitled "Ink Jet Recording Element"; and Ser. No. 09/580,184, filed of even date herewith, of Missell et al., entitled "Ink Jet Recording Element";

the teachings of which are incorporated herein by reference.

FIELD OF THE INVENTION

This invention relates to an ink jet printing method which uses an ink jet recording element which contains certain cellulosic fibers.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having thereon a base layer for absorbing fluid and an ink-receiving or image-forming layer. The recording element may be porous or non-porous.

Many porous ink jet receivers consist of organic or inorganic particles that form pores by the spacing between the particles, The ink and solvents are pulled into this structure by capillary forces. In order to have enough pore volume or capacity to absorb heavy ink lay downs, these coatings are usually coated to a dry thickness on the order of 40 $\mu$m to 60 $\mu$m, which can be costly because of the layer thickness.

To form a porous ink receiving layer, a binder is added to hold the particles together. However, to maintain a high pore volume, the amount of binder should be as low as possible. Too much binder would start to fill the pores between the particles or beads, which will reduce ink absorption. Too little binder will reduce the integrity of the coating causing cracking.

U.S. Pat. Nos. 5,522,968 and 5,635,297 relate to ink jet receiver elements comprising a support containing cellulose or wood pulp. There is a problem with these elements, however, in that ink jet inks printed on them would tend to bleed through the paper causing paper cockle and low optical density. It is an object of this invention to provide an ink jet printing method which uses an ink jet receiver element which has fast dry times, no paper cockle, high optical density and a lower tendency to crack.

SUMMARY OF THE INVENTION

This and other objects are provided by the present invention comprising an ink jet printing method, comprising the steps of:

A) providing an ink jet printer that is responsive to digital data signals;

B) loading the printer with an ink jet recording element comprising a resin-coated paper support having thereon an ink-retaining layer comprising voided cellulosic fibers and organic or inorganic particles in a polymeric binder, the length of the voided cellulosic fibers being from about 10 $\mu$m to about 50 $\mu$m, the ratio of the voided cellulosic fibers to the organic or inorganic particles being from about 90:10 to about 60:40 and the ratio of the combination of voided cellulosic fibers and the organic or inorganic particles to the polymeric binder being from about 90:10 to about 50:50;

C) loading the printer with an ink jet ink composition; and

D) printing on the ink jet recording element using the ink jet ink in response to the digital data signals.

Using the method of the invention, an ink jet receiver element is obtained which has less cracking than prior art elements.

DETAILED DESCRIPTION OF THE INVENTION

The voided cellulosic fibers used in the ink-retaining layer of the ink jet recording element employed in the process of the invention have greatly increased porosity over organic or inorganic particles usually used in porous layers of many ink jet recording elements. In addition, these voided cellulosic fibers have an internal voided structure that allows them to act as "micro-straws" to further assist in absorbing fluids. This voided cellulosic fiber structure provides very fast dry times with very heavy ink lay volumes. In addition, the images obtained using the voided cellulosic fiber layer also have high optical density.

Examples of voided cellulosic fibers which can be used in the invention include Arbocel® alpha cellulose fibers, manufactured by Rettenmaier of Germany. These cellulosic fibers are made of different woods such as beech, maple or pine, preferably beech. The fibers also vary in length from about 10 $\mu$m to about 50 $\mu$m, with the preferred length of less than about 30 $\mu$m. The width of the fibers is about 18 $\mu$m.

Any polymeric binder may be used in the ink-retaining layer of the ink jet recording element employed in the process of the invention. In general, good results have been obtained with gelatin, a polyurethane, a vinyl acetate-ethylene copolymer, an ethylene-vinyl chloride copolymer, a vinyl acetate-vinyl chloride-ethylene terpolymer, all acrylic polymer or a polyvinyl alcohol.

The organic or inorganic particles used in the ink-retaining layer may be, for example, alumina particles, silica particles or polymer beads, such as methyl methacrylate or styrene.

Any resin-coated paper support may be used in the process of the invention, such as, for example, Kodak photo grade Edge Paper®, Kodak Royal® Paper and Kodak D'Lite® Paper.

If desired, in order to improve the adhesion of the fiber layer to the support, the surface of the support may be corona discharge-treated prior to coating.

The layers described above may be coated by conventional coating means onto a support material commonly used in this art. Coating methods may include, but are not limited to, wound wire rod coating, slot coating, slide hopper coating, gravure, curtain coating and the like.

Ink jet inks used to image the recording elements employed in the process of the present invention are well-known in the art. The ink compositions used in ink jet printing typically are liquid compositions comprising a solvent or carrier liquid, dyes or pigments, humectants, organic solvents, detergents, is thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following example further illustrates the invention.

EXAMPLE

Element 1 (Fibers and Polymer Particles) (Invention)

A solution of Arbocel® alpha beech 17 μm fibers and methyl methacrylate beads (Eastman Kodak Co.) at a ratio of 80:20 and gelatin at a weight ratio of 85 (fibers plus beads)/15 was prepared at 20% solids. This was coated using a metered rod at 110 μm wet laydown, on a corona discharged-treated, resin coated, photo grade paper, Kodak Edge® Paper, and oven dried at 150° F. for 30 minutes, to a dry thickness of 25 μm.

Element 2 (Fibers and Polymer Particles) (Invention)

This element was the same as Element 1 except that the beech fibers were 20 μm.

Element 3 (Fibers and Polymer Particles) (Invention)

This element was the same as Element 1 except that the beech fibers were 30 μm.

Element 4 (Fibers and Polymer Particles) (Invention)

This element was the same as Element 1 except that the fibers were maple fibers at 30 μm.

Element 5 (Fibers and Polymer Particles) (Invention)

This element was the same as Element 1 except that the fibers were pine fibers at 30 μm.

Element Control C-1 (Polymer Particles Only)

This element was the same as Element 1 except that it contained no fibers.

Element 6 (Fibers and Alumina) (Invention)

This element was the same as Element 1 except that alumina particles were used instead of the polymer particles.

Element Control C-2 (Alumina Particles Only)

This element was the same as Element 6 except that it contained no fibers.

Element 7 (Fibers and Silica) (Invention)

This element was the same as Element 1 except that silica particles were instead of the polymer particles.

Control C-3 (Silica Particles Only)

This element was the same as Element 7 except that it contained no fibers.

Testing

Each coated element was examined with the naked eye and under 60× magnification to observe any cracking in the coating and the results given in the Table below. The cracking was rated using the following scale:

| Cracking Level | Cracking Description |
|---|---|
| 1 | No cracks observed under 60× magnification |
| 2 | Need 60× magnification to observe non continuous small cracks that do not show in printed images |
| 3 | Need 60× magnification to observe continuous cracks that do not show in printed images |
| 4 | Cracks visible to naked eye and very noticeable in printed images |
| 5 | Cracks and flaking of coating prevent any imaging |

A rating of 3 or less is acceptable.

TABLE

| Element | Cracking Description |
|---|---|
| 1 | 2 |
| 2 | 2 |
| 3 | 2 |
| 4 | 2 |
| 5 | 2 |
| C-1 | 5 |
| 7 | 1 |
| C-2 | 4 |
| 3 | 2 |
| C-3 | 5 |

The above results show that the elements employed in the process of the invention had much less cracking than the control elements.

Printing

Each of the above elements of the invention was images on an Epson 740 printer using the inks S020189 (Blacks) and S020191 (Color). A high quality image with good density was obtained having an acceptable dry time.

This invention has been described with particular reference to preferred embodiments thereof but it will be understood that modifications can be made within the spirit and scope of the invention.

What is claimed is:

1. An ink jet printing method, comprising the steps of:

A) providing an ink jet printer that is responsive to digital data signals;

B) loading said printer with ink jet recording element comprising a resin-coated paper support having thereon an ink-retaining layer comprising voided cellulosic fibers and organic or inorganic particles in a polymeric binder, the length of said voided cellulosic fibers being from about 10 μm to about 50 μm, the ratio of said voided cellulosic fibers to said organic or inorganic particles being from about 90:10 to about 60:40 and the ratio of the combination of voided cellulosic fibers and said organic or inorganic particles to said polymeric binder being from about 90:10 to about 50:50, said cellulosic fibers being derived from beech pulp, maple pulp or pine pulp, said voided cellulosic fibers having an internal voided structure that enables them to act as micro-straws to assist in absorbing fluid;

C) loading said printer with an ink jet composition; and

D) printing on said ink jet recording element using said ink jet ink in response to said digital data signals.

2. The method of claim 1 wherein said cellulosic fibers are less than about 30 $\mu$m and have a width of about 18 $\mu$m.

3. The method of claim 1 wherein said polymeric binder comprises gelatin, a polyurethane, a vinyl acetate-ethylene copolymer, an ethylene-vinyl chloride copolymer, a vinyl acetate-vinyl chloride-ethylene terpolymer, an acrylic polymer or a polyvinyl alcohol.

4. The method of claim 1 wherein said organic or inorganic particles comprises alumina particles, silica particles or polymer beads.

* * * * *